United States Patent [19]

Williams

[11] 4,360,105

[45] Nov. 23, 1982

[54] FOOD CONTAINER

[76] Inventor: Lavada G. Williams, 4023 Balfour Ave., Oakland, Calif. 94610

[21] Appl. No.: 257,713

[22] Filed: Apr. 27, 1981

[51] Int. Cl.[3] ..... A45C 11/20

[52] U.S. Cl. ..... 206/544; 206/545; 220/412

[58] Field of Search ..... 220/411, 412; 206/544, 206/545

[56] References Cited

U.S. PATENT DOCUMENTS

| | | | |
|---|---|---|---|
| 1,773,663 | 8/1930 | Dickens | 206/544 |
| 2,465,910 | 3/1949 | Mills | 206/544 |
| 2,577,959 | 11/1951 | Gaffuso | 206/545 |
| 2,645,332 | 7/1953 | Martin | 206/545 |
| 2,740,546 | 4/1956 | Kowalski | 220/411 |
| 3,613,872 | 10/1971 | Donnelly | 206/545 |
| 3,805,018 | 4/1974 | Luong | 206/545 |

*Primary Examiner*—George E. Lowrance
*Attorney, Agent, or Firm*—Bielen and Peterson

[57] ABSTRACT

A food container comprising a receptacle having bottom and side portions which form a containing space. A support is positioned within the receptacle and includes at least one partition for forming at least first and second cavities within the containing space. A member overlies the support and substantially encloses the same in relation to the side portions of the receptacle. A cover overlies the member to form a chamber therebetween which may be heat insulated from the cavities.

8 Claims, 2 Drawing Figures

FOOD CONTAINER

BACKGROUND OF THE INVENTION

The present invention relates to a food container having a multiplicity of chambers for storage of food stuffs at different temperatures.

It is desirable to transport food stuffs, including solid foods and beverages, from one place to another. The common picnic basket and thermos have generally been used to form these functions in the past. Unfortunately, such a system of transporting food stuffs is difficult because the containers are bulky and difficult to handle.

There have been several designs for food containers which attempt to incorporate the storage capabilities of the prior art into one transportable unit. U.S. Pat. No. 1,343,299 to Barrows shows a liquid receptacle for use in the dentistry field which employs various partitions to form side by side chambers for the storage of liquids. Along these lines, U.S. Pat. No. 3,589,566 to Rivest describes an insulated container having multiple chambers for dispensing of fluid for consumption. U.S. Pat. No. 3,705,661 shows a thermally insulated container having multiple beverage receptacles within a container surrounded by a sealed air compartment. The container shown in U.S. Pat. No. 2,746,634 to Smith describes sectional thermos food containers which may be used for liquid or solid food storage having self contained components assembled into a single container. U.S. Pat. No. 3,245,565 to Zeppenfeld et al shows a liquid or semi-liquid food container which includes a spout to permit consumption of the liquid directly from the container.

A food container having the capability of transporting liquids and solids at different temperatures would be a useful advance in the art of food containers.

SUMMARY OF THE INVENTION

In accordance with the present invention a novel and useful food container is provided having capabilities of storing food stuffs at various temperatures.

The food container of the present invention employs a receptacle having a bottom and side portions forming a space for containing the food stuffs. The receptacle may include a handle and be heat insulated as desired.

A support is also provided in the present invention to be placed within the receptacle in either removable or unitary form. This support has at least one partition forming a pair of cavities within the containing space. The partition may be heat insulated and be capable of holding heat retaining or cooling media.

A member is also included which overlies the support and substantially closes the first and second cavities in relation to the side and bottom portions of the receptacle. The member may be heat insulated to further retain the hot or cool state of the cavities below the same. A cover overlies the member and forms a chamber which may be employed to store items not requiring heating or cooling. In addition, the member may include an opening therethrough to connect the chamber with a cavity or cavities below. Such a feature may be useful to hold a cannister containing liquids which may be accessible without removing the member from the food container described.

It may be apparent that a novel and useful food container for the storage and transportation of food stuffs has been described.

It is therefore an object of the present invention to provide a food container which employs a multi-chamber structure to hold a variety of food stuffs in either a hot or cold condition.

It is another object of the present invention to provide a food container which is capable of storing non-edible items, which do not require the maintenance of a hot or cold temperature.

It is yet another object of the present invention to provide a food container which is easily disassembled for cleaning and easily reassembled for use thereafter.

It is yet another object of the present invention to provide a food container which is capable of holding a commercially available tray having preprocessed food thereupon, commonly known as a "frozen TV dinner".

The invention possesses other objects and advantages as concerns particular characteristics and features thereof which will become apparent as the specification continues.

BRIEF DESCRIPTION OF THE DRAWINGS

FIG. 2 is a view taken along line 2—2 of FIG. 1.

For a better understanding of the invention references is made to the following detailed description which should be referenced to the hereinabove described drawings.

DESCRIPTION OF THE PREFERRED EMBODIMENTS

Various aspects of the present invention will evolve from the following detailed description of the preferred embodiments thereof which should be taken in conjunction with the hereinabove described drawings.

Figure 1:
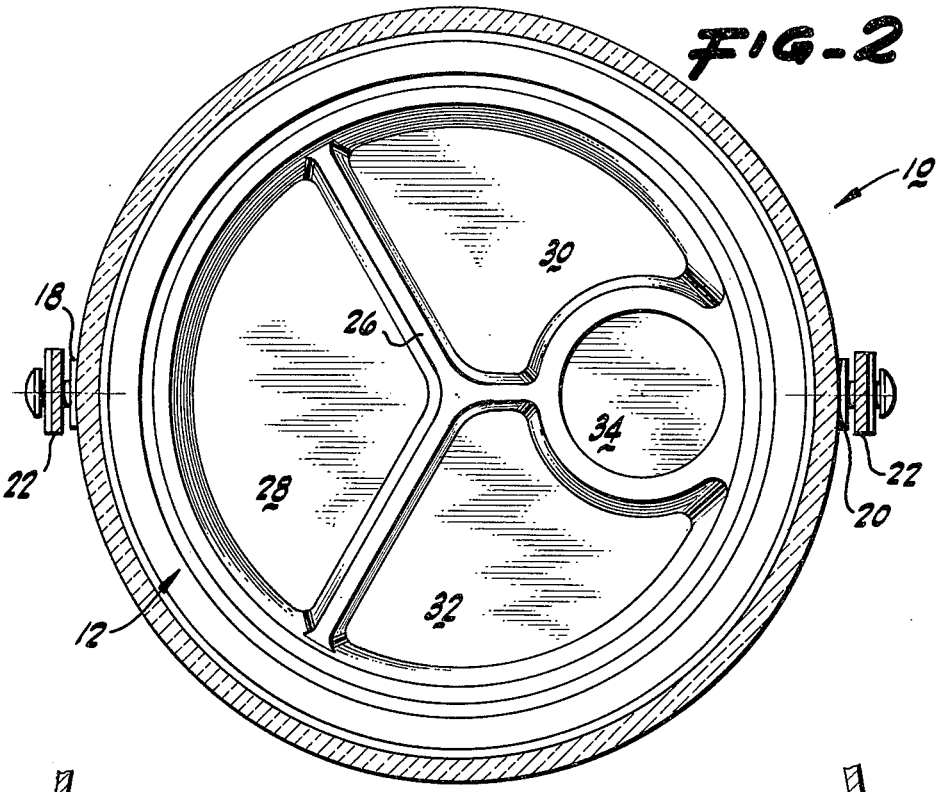
FIG. 1 is a sectional view of the food container of the present invention showing a handle portion in broken configuration.
Figure 1:
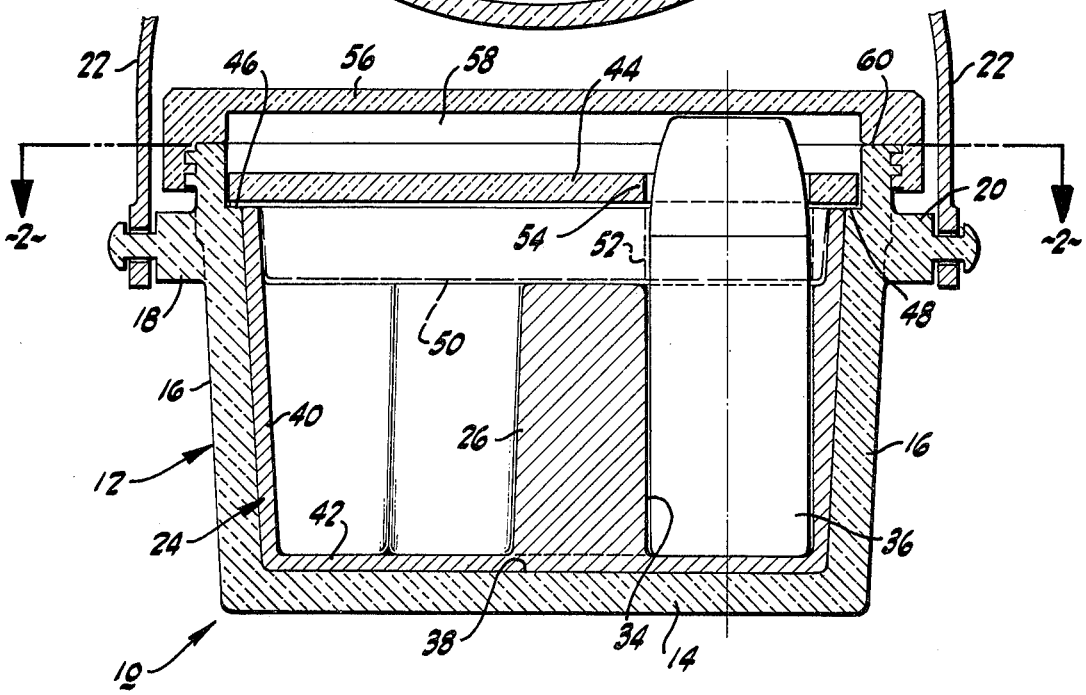

The invention as a whole is represented in the drawings by reference character 10 and includes a receptacle 12 which may be constructed of insulating material such as plastic, fiberboard, and the like. Receptacle 12 includes a bottom portion 14 and side portions 16. As shown in FIG. 1, receptacle 12 may be in the shape of a truncated cone. Receptacle 12 includes a pair of bosses 18 and 20 and handle means 22 connected thereto for carrying container 10.

Container 10 may also embrace a support 24 which may be constructed as part of receptacle 12 or be removably placed within the same as shown in FIG. 1. Support 24 may be constructed of plastic and include a partition 26, FIG. 2, which forms cavities 28, 30, 32, and 34. Cavity 34 has been formed to hold a thermos or other beverage containing vessel 36. Thus, the containing space 38 of receptacle 12 has been divided into a multiplicity of cavities 28, 30, 32 and 34, by support 24. Cavities 28, 30, 32, and 34 may be used to hold heating or cooling media such as ice, eutectic mixtures, and the like. Partition 26 may be insulated to prevent the passage of heat between cavities. For example, cavity 32 may be of a higher temperature than cavity 34. Support 24 may also include side portions 40 and a bottom 42. Side portions 40 may be sloped to coincide with the slope of side 16 of container 10. As is known in the art, this expedient may be employed to facilitate the molding of container 10.

A member 44 is also included in the present invention and overlies support 24 as shown in FIG. 1. Support 24 may be constructed of heat insulating material since it substantially covers the cavities formed by partition 26 therebelow. Member 44 may rest upon the top surface 46 or rim 48 of receptacle 12. As shown in FIG. 1, a tray 50 has been interposed member 44 and support and rim 48. Tray 50 may be of a commercially available type such as those used to hold frozen dinners. In the case where tray 50 includes an opening 52 therethrough, member 44 may also include an opening 54 therethrough. Thus, beverage vessel is accessible without removal of member 44 from receptacle 12. Where tray 50 is not employed, member 44 may rest upon surface 46 and/or rim 48. As shown in FIG. 1, member 44 is removable from its position. Tray 50 may take many forms for any food stuff.

The container 10 also employs a cover 56 which overlies member 44 to form a chamber 58 therebetween. Cover 56 may be threaded onto the upper portion 60 of receptacle 12. Non-food stuffs, such as utensils, napkins, and other items, may be placed in chamber 58 without the necessity of cooling or heating of the same. On the other hand, chamber 58 may serve as a heat insulated space for hot or cold items.

In operation, the user places hot or cold items within any of the cavities 28, 30, 32, or 34. Heating or cooling media may be used to maintain the temperature of the items placed in these cavities. A tray 50 may be used in lieu of the cavities and contain hot or cold food stuffs which are insulated by the cavities. A member 44 is placed over the cavities and/or tray 50 to further insulate the items stored therebelow. Where the structure of tray 50 permits, an opening 54 may be employed in member 44 to accomodate beverage vessel 36 which extends to the bottom of cavity 34. Chamber 58 may be used to store other items not necessarily those needing heat insulation. Cover 56 is placed over member 44 and tightened to hold container 10 for transportation or storage. Handle means 22 may be used to easily carry container 10 as desired.

While in the foregoing embodiments of the present invention have been set forth in considerable detail for the purposes of making a complete disclosure of the invention, it will be apparent to those of ordinary skill in the art that numerous changes may be made in such details without departing from the spirit and principles of the invention.

What is claimed is:

1. A food container comprising:

a. a receptacle having bottom and side portions forming a container of space;

b. a support within said receptacle having at least one partition forming at least a first and second cavity within said container of space;

c. a tray overlying said support, said tray enclosing said at least first and second cavities, said tray including an opening therethrough aligned with said first cavity;

d. a member overlying said tray and support, said member substantially enclosing said first and second cavities and enclosing said tray overlying said cavities in relation to said receptacle; said member including an opening therethrough aligned with said first cavity;

e. a cover overlying said member forming a chamber therebetween; said aligned openings of said tray and said member permitting the passage of a food item from said first cavity to said chamber.

2. The food container of claim 1 in which said member includes means for heat insulating said first and second cavities from said chamber.

3. The food container of claim 1 in which said partition includes means for heat insulating said first cavity from said second cavity.

4. The food container of claim 3 in which said support is capable of being removably positioned within said receptacle.

5. The food container of claim 4 in which said support includes means for holding said member in overlying relationship in relation to said platform.

6. The food container of claim 2 in which said member is removably supported in overlying relationship to said first and second cavities.

7. The food container of claim 6 in which said member includes means for heat insulating said first and second cavities from said chamber.

8. The food container of claim 1 in which said support is capable of being removably positioned within said receptacle.

* * * * *